US009343008B2

(12) United States Patent
Madhusudan

(10) Patent No.: US 9,343,008 B2
(45) Date of Patent: May 17, 2016

(54) ORGANIC LIGHT EMITTING DIODE DISPLAY

(71) Applicant: Samsung Display Co., Ltd., Yongin, Gyeonggi-do (KR)

(72) Inventor: Singh Madhusudan, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 236 days.

(21) Appl. No.: 13/963,706

(22) Filed: Aug. 9, 2013

(65) Prior Publication Data

US 2014/0313112 A1 Oct. 23, 2014

(30) Foreign Application Priority Data

Apr. 23, 2013 (KR) ..... 10-2013-0044903

(51) Int. Cl.
*G09G 3/02* (2006.01)
*G09G 3/32* (2016.01)

(52) U.S. Cl.
CPC ..... *G09G 3/3208* (2013.01); *G09G 2300/0452* (2013.01)

(58) Field of Classification Search
None
See application file for complete search history.

(56) References Cited

U.S. PATENT DOCUMENTS

2004/0113875 A1* 6/2004 Miller ..... G09G 3/3216 345/82
2005/0270444 A1* 12/2005 Miller ..... G09G 3/3216 349/108
2009/0046307 A1 2/2009 Kwak et al.
2010/0141693 A1* 6/2010 Lee ..... G09G 3/3216 345/694

FOREIGN PATENT DOCUMENTS

JP 2012-118538 6/2012
KR 10-2007-0082730 8/2007

* cited by examiner

*Primary Examiner* — Kathy Wang-Hurst
*Assistant Examiner* — Douglas M Wilson
(74) *Attorney, Agent, or Firm* — Knobbe Martens Olson & Bear LLP

(57) ABSTRACT

An organic light emitting diode (OLED) display includes: a substrate; and a red subpixel, a green subpixel, a blue subpixel, and a white subpixel arranged in a matrix of rows and columns on the substrate, wherein three different-colored subpixels selected from the red subpixel, the green subpixel, the blue subpixel, and the white subpixel form one pixel in which the three different-colored subpixels are simultaneously driven. Four red subpixels in the matrix enclose two green subpixels, two white subpixels, and one blue subpixel. Accordingly, the organic light emitting diode (OLED) display has a RGBW structure, and improves the luminance by the two white subpixels.

5 Claims, 4 Drawing Sheets

ORGANIC LIGHT EMITTING DIODE DISPLAY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims priority to and the benefit of Korean Patent Application No. 10-2013-0044903 filed in the Korean Intellectual Property Office on Apr. 23, 2013, the entire contents of which are incorporated herein by reference.

BACKGROUND

1. Field

The described technology relates generally to an organic light emitting diode (OLED) display.

2. Description of the Related Technology

An organic light emitting diode display typically includes two electrodes and an organic emission layer interposed therebetween. Electrons injected from one electrode and holes injected from the other electrode are bonded to each other in the organic emission layer to form excitons, and light is emitted while the excitons discharge energy.

To realize colors of the organic light emitting diode (OLED) display, it is not necessary to deposit organic light emitting materials of red, green, and blue, but a red color filter, a green color filter, and a blue color filter may be simply disposed on a white organic light emitting material so the color organic light emitting diode (OLED) display of an RGB structure including red, green, and blue subpixels may be realized. However, to improve the luminance and the resolution of the color organic light emitting diode (OLED) display of the RGB structure, the power consumption and the manufacturing cost are generally increased, such that an organic light emitting diode (OLED) display of an RGBW structure including the red, the green, the blue, and the white subpixels has been developed to prevent this problem and to improve the luminance and contrast ratio. This RGBW structure may have various arrangements, for example four subpixels form one pixel in a stripe-type RGBW structure such that the number of data lines is increased and the aperture ratio and resolution are reduced, four subpixels form one pixel in a checkerboard-type RGBW structure such that the aperture ratio and resolution are reduced, and the resolution is decreased to less than 220 ppi in a pentile type RGBW structure.

The above information disclosed in this Background section is only for enhancement of understanding of the background of the described technology and therefore it may contain information that does not form the prior art that is already known in this country to a person of ordinary skill in the art.

SUMMARY OF CERTAIN INVENTIVE ASPECTS

Embodiments herein provide an organic light emitting diode (OLED) display with improved luminance without a deterioration of the aperture ratio and resolution, and without increasing the number of data lines.

An organic light emitting diode (OLED) display according to an embodiment includes: a substrate; and a red subpixel, a green subpixel, a blue subpixel, and a white subpixel arranged in a matrix or rows and columns on the substrate, wherein three different-colored subpixels of the red subpixel, the green subpixel, the blue subpixel, and the white subpixel form one pixel in which said three different-colored subpixels are simultaneously driven, and wherein four red subpixels in the matrix enclose two green subpixels, two white subpixels, and one blue subpixel.

One green subpixel, one blue subpixel, and one white subpixel may be disposed between two red subpixels of a same row in the matrix, and one green subpixel, one blue subpixel, and one white subpixel may be disposed between two red subpixels of the a column in the matrix.

The pixel may include a first row pixel, a second row pixel, a third row pixel, and a fourth row pixel in which three subpixels of the subpixels are disposed in a row direction in different orders, the first row pixel may include the red subpixel, the green subpixel, and the blue subpixel disposed from left to right, the second row pixel may include the blue subpixel, the white subpixel, and the red subpixel disposed from left to right, the third row pixel may include the green subpixel, the red subpixel, and the white subpixel disposed from left to right, and the fourth row pixel may include the white subpixel, the blue subpixel, and the green subpixel disposed from left to right.

The pixel may include a first column pixel, a second column pixel, a third column pixel, and a fourth column pixel in which three subpixels of the subpixels are disposed in a column direction in different orders, the first column pixel may include the red subpixel, the blue subpixel, and the green subpixel disposed top to bottom, the second column pixel may include the green subpixel, the white subpixel, and the red subpixel disposed top to bottom, the third column pixel may include the blue subpixel, the red subpixel, and the white subpixel disposed top to bottom, and the fourth column pixel may include the white subpixel, the green subpixel, and the blue subpixel disposed top to bottom.

The red subpixel, the green subpixel, the blue subpixel, and the white subpixel may be disposed from left to right in the first row, the blue subpixel, the white subpixel, the red subpixel, and the green subpixel may be disposed from left to right in the second row under the first row, the green subpixel, the red subpixel, the white subpixel, and the blue subpixel may be disposed from left to right in the third row under the second row, and the white subpixel, the blue subpixel, the green subpixel, and the red subpixel may be disposed from left to right in the fourth row under the third row.

In the subpixel group, the red subpixel, the blue subpixel, the green subpixel, and the white subpixel may be sequentially disposed from top to bottom at the first column, the green subpixel, the white subpixel, the red subpixel, and the blue subpixel may be sequentially disposed from top to bottom at the second column of the right of the first column, the blue subpixel, the red subpixel, the white subpixel, and the green subpixel may be sequentially disposed from top to bottom at the third column of the right of the second column, and the white subpixel, the green subpixel, the blue subpixel, and the red subpixel may be sequentially disposed from top to bottom at the fourth column of the right of the third column.

The subpixel group may be repeatedly disposed.

The organic light emitting diode (OLED) display according to an embodiment has the RGBW structure, however three subpixels of the red subpixel, the green subpixel, the blue subpixel, and the white subpixel form one pixel, and four red subpixels enclose two green subpixel, two white subpixel, and one blue subpixel, thereby improving the luminance by two white subpixels.

Also, the organic light emitting diode (OLED) display according to an embodiment has the RGBW structure, however one pixel includes three subpixels that are simultaneously driven such that the resolution and the aperture ratio are not reduced compared with the conventional RGBW structure in which one pixel includes four subpixels.

In addition, the organic light emitting diode (OLED) display according to an embodiment has the RGBW structure, however one pixel includes three subpixels that are simultaneously driven such that the number of data lines is not increased compared with the conventional RGBW structure in which one pixel includes four subpixels.

DETAILED DESCRIPTION OF CERTAIN INVENTIVE EMBODIMENTS

Embodiments of the invention will be described more fully hereinafter with reference to the accompanying drawings, in which certain embodiments of the invention are shown. As those skilled in the art would realize, the described embodiments may be modified in various ways, without departing from the spirit or scope of the present invention.

Figure 1:
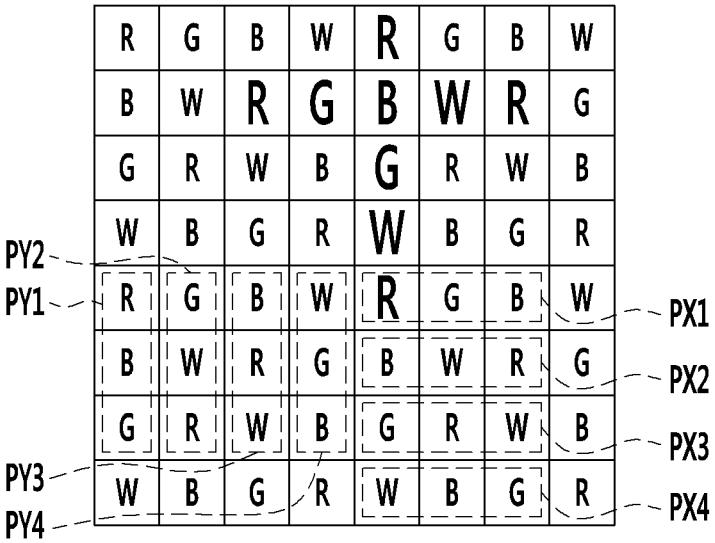
FIG. 1 is a layout view of a subpixel of an organic light emitting diode (OLED) display according to an embodiment.

FIG. 1 is a layout view of a subpixel of an organic light emitting diode (OLED) display according to an embodiment.

As shown in FIG. 1, an organic light emitting diode (OLED) display according to one embodiment includes a red subpixel (R), a green subpixel (G), a blue subpixel (B), and a white subpixel (W). The red subpixel (R) emits red light, the green subpixel (G) emits green light, the blue subpixel (B) emits blue light, and the white subpixel (W) emits white light having high luminance.

One pixel includes any three subpixels among the red subpixel (R), the green subpixel (G), the blue subpixel (B), and the white subpixel (W), and three subpixels are simultaneously driven.

The pixel includes one of a first row pixel PX1, a second row pixel PX2, a third row pixel PX3, and a fourth row pixel PX4 in which three subpixels among the subpixels are disposed according to a different order in a row direction.

The first row pixel PX1 includes the red subpixel (R), the green subpixel (G), and the blue subpixel (B) that are disposed from left to right, the second row pixel PX2 includes the blue subpixel (B), the white subpixel (W), and the red subpixel (R) that are disposed from left to right, the third row pixel PX3 includes the green subpixel (G), the red subpixel (R), and the white subpixel (W) that are disposed from left to right, and the fourth row pixel PX4 includes the white subpixel (W), the blue subpixel (B), and the green subpixel (G) that are disposed from left to right.

Also, the pixel includes one of a first column pixel PY1, a second column pixel PY2, a third column pixel PY3, and a fourth column pixel PY4 in which three subpixels are disposed according to a different order in the column direction among the subpixels.

The first column pixel PY1 includes the red subpixel (R), the blue subpixel (B), and the green subpixel (G) that are disposed top to bottom, the second column pixel PY2 includes the green subpixel (G), the white subpixel (W), and the red subpixel (R) that are disposed top to bottom, the third column pixel PY3 includes the blue subpixel (B), the red subpixel (R), and the white subpixel (W) that are disposed top to bottom, and the fourth column pixel PY4 includes the white subpixel (W), the green subpixel (G), and the blue subpixel (B) that are disposed top to bottom.

Four red subpixels (R) that are indicated in bold in FIG. 1 enclose two green subpixels (G), two white subpixels (W), and one blue subpixel (B). One green subpixel (G), one blue subpixel (B), and one white subpixel (W) are disposed between two red subpixels (R) of the same row, and one green subpixel (G), one blue subpixel (B), and one white subpixel (W) are disposed between two red subpixels (R) of the same column.

As described above, the organic light emitting diode (OLED) display according to one embodiment is an organic light emitting diode (OLED) display of the RGBW structure, however any three subpixels among the red subpixel (R), the green subpixel (G), the blue subpixel (B), and the white subpixel (W) may form one pixel, and four red subpixels (R) enclose two green subpixels (G), two white subpixels (W), and one blue subpixel (B) such that luminance may be improved by two white subpixels (W).

Also, the organic light emitting diode (OLED) display has the RGBW structure, however one pixel includes three subpixels that are simultaneously driven such that the resolution and the aperture ratio are not decreased compared with the conventional RGBW structure in which one pixel includes four subpixels.

Also, the organic light emitting diode (OLED) display has the RGBW structure, however one pixel includes three subpixels that are simultaneously driven such that the number of data lines is not reduced compared with the conventional RGBW structure in which one pixel includes four subpixels.

Figure 2:
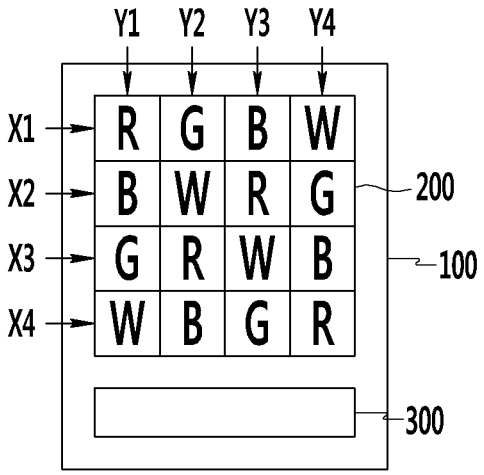
FIG. 2 is a view of a subpixel group of an organic light emitting diode (OLED) display according to an embodiment.

The arrangement structure in which four red subpixels (R) enclose two green subpixels (G), two white subpixels (W), and one blue subpixel (B) may be formed by forming and repeating a subpixel group as shown in FIG. 2.

FIG. 2 is a view of a subpixel group of an organic light emitting diode (OLED) display according to an embodiment.

As shown in FIG. 2, an organic light emitting diode (OLED) display 100 according to one embodiment drives a subpixel group 200 by using a driving circuit unit 300. The subpixel group 200 includes sixteen subpixels, and the subpixel group 200 is repeatedly arranged.

In the subpixel group 200, the red subpixel (R), the green subpixel (G), the blue subpixel (B), and the white subpixel (W) are disposed from left to right at the first row X1, the blue subpixel (B), the white subpixel (W), the red subpixel (R), and the green subpixel (G) are disposed from left to right at the second row X2 under the first row X1, the green subpixel (G), the red subpixel (R), the white subpixel (W), and the blue subpixel (B) are disposed from left to right at the third row X3 under the second row X2, and the white subpixel (W), the blue subpixel (B), the green subpixel (G), and the red subpixel (R) are disposed from left to right at the fourth row X4 under the third row X3.

Also, the red subpixel (R), the blue subpixel (B), the green subpixel (G), and the white subpixel (W) are sequentially disposed from top to bottom at the first column Y1, the green subpixel (G), the white subpixel (W), the red subpixel (R), and the blue subpixel (B) are sequentially disposed from top to bottom at the second column Y2 of the right side of the first column Y1, the blue subpixel (B), the red subpixel (R), the white subpixel (W), and the green subpixel (G) are sequentially disposed from top to bottom at the third column Y3 of the right side of the second column Y2, and the white subpixel (W), the green subpixel (G), the blue subpixel (B), and the red subpixel (R) are sequentially disposed from top to bottom at the fourth row Y4 of the right side of the third column Y3.

By repeatedly arranging the subpixel group 200, the arrangement in which four red subpixels (R) enclose two green subpixels (G), two white subpixels (W), and one blue subpixel (B) may be realized.

Next, a detailed structure of a subpixel of an organic light emitting diode (OLED) display according to one embodiment will be described with reference to FIG. 3 and FIG. 4.

Figure 3:
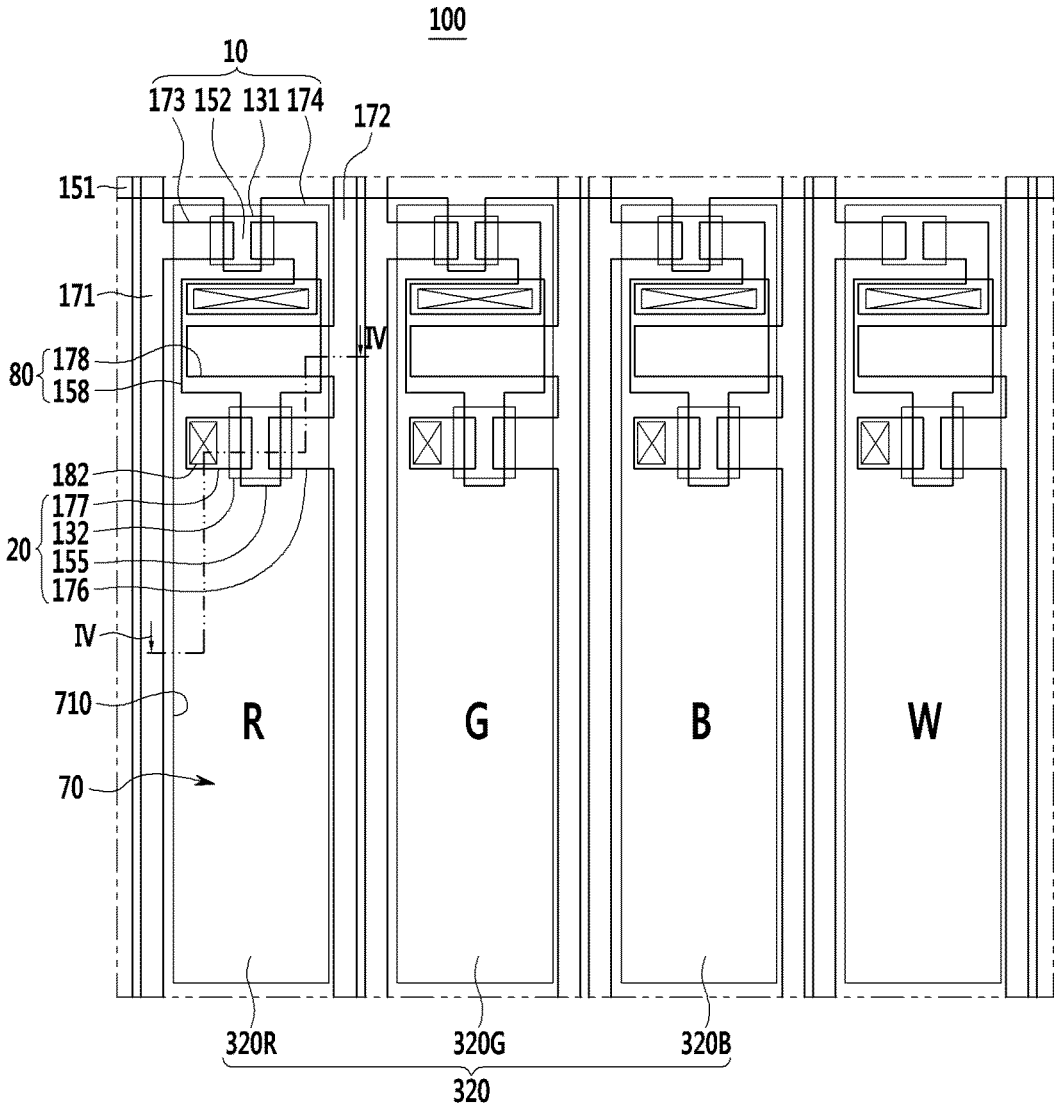
FIG. 3 is a layout view of a subpixel of an organic light emitting diode (OLED) display according to an embodiment.
Figure 4:
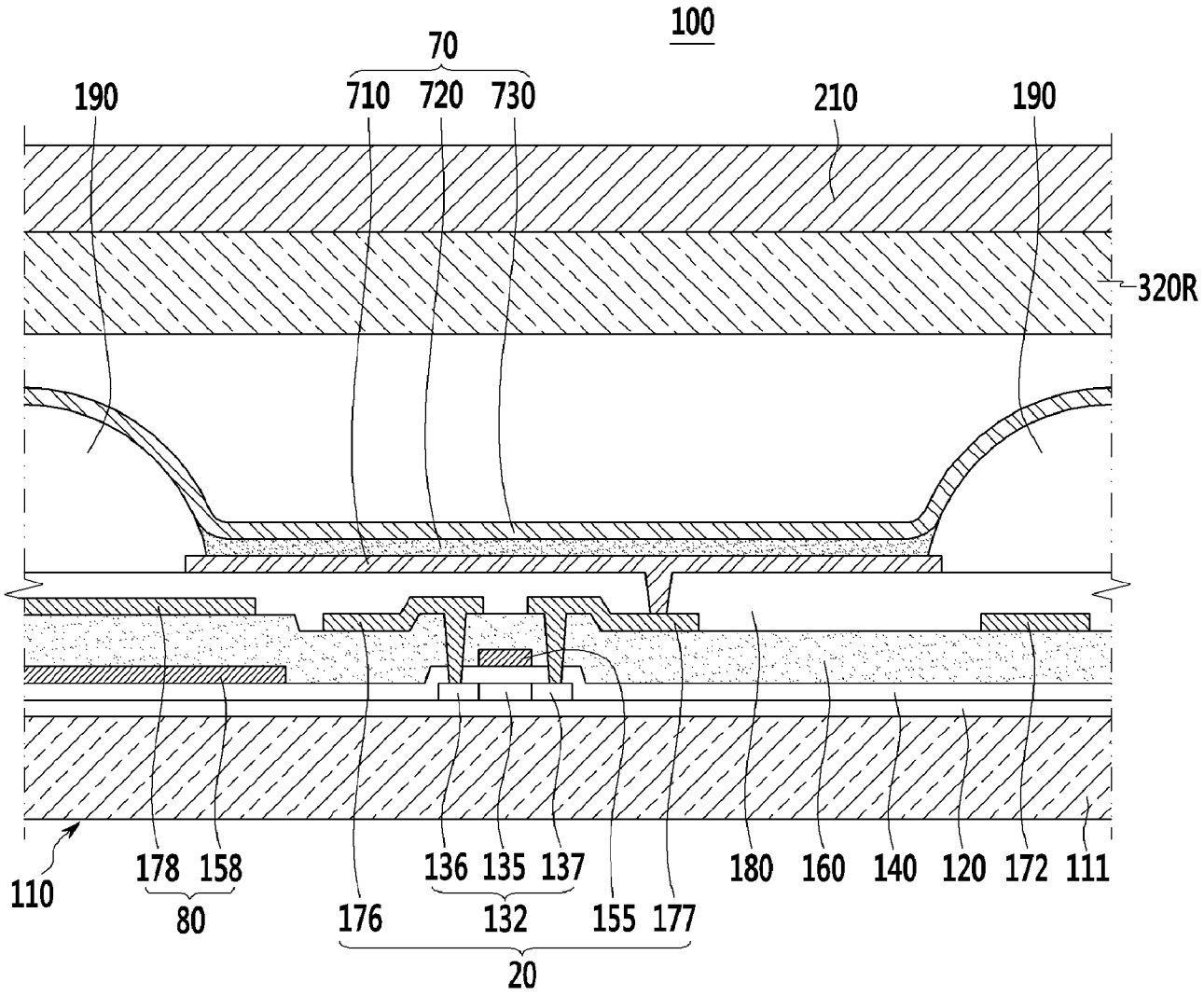
FIG. 4 is a cross-sectional view of the organic light emitting diode (OLED) display of FIG. 3 taken along the line IV-IV.

FIG. 3 is a layout view of a subpixel of an organic light emitting diode (OLED) display according to an embodiment, and FIG. 4 is a cross-sectional view of the organic light emitting diode (OLED) display of FIG. 3 taken along the line IV-IV.

As shown in FIG. 3 and FIG. 4, a display substrate 110 of an organic light emitting diode (OLED) display according to one embodiment includes a switching thin film transistor 10, a driving thin film transistor 20, a capacitor 80, and an organic light emitting element 70 that make up each of the subpixels R, G, B, and W. Also, the display substrate 110 further includes gate lines 151 disposed along one direction, and data lines 171 and common power lines 172 that respectively cross the gate lines 151 and are insulated therefrom. Here, one subpixel can be defined by a boundary of a gate line 151, a data line 171, and a common power line 172, but is not limited thereto.

The organic light emitting element 70 includes a first electrode 710, an organic emission layer 720 formed on the first electrode 710, and a second electrode 730 formed on the organic emission layer 720. The first electrode 710 is an anode (+) electrode which is a hole injection electrode, and the second electrode 730 is a cathode (−) electrode which is an electron injection electrode. Holes and electrons are respectively injected from the first electrode 710 and the second electrode 730 into the organic emission layer 720, and form excitons. When excitons of which the injected holes and electrons are coupled fall from an excited state to a ground state, light is emitted.

The capacitor 80 includes a first capacitive plate 158 and a second capacitive plate 178 that are disposed with an interlayer insulating layer 160 disposed therebetween. The interlayer insulating layer 160 becomes a dielectric material. Storage capacity is determined by electric charges stored in the storage capacitor 80 and a voltage between the storage plates 158 and 178.

The switching thin film transistor 10 includes a switching semiconductor layer 131, a switching gate electrode 152, a switching source electrode 173, and a switching drain electrode 174. The driving thin film transistor 20 includes a driving semiconductor layer 132, a driving gate electrode 155, a driving source electrode 176, and a driving drain electrode 177.

The switching thin film transistor 10 is used as a switching element for selecting a pixel to emit light. The switching gate electrode 152 is connected to the gate line 151. The switching source electrode 173 is connected to the data line 171. The switching drain electrode 174 is separated from the switching source electrode 173 and is connected to the first capacitive plate 158.

The driving thin film transistor 20 applies driving power for allowing the organic emission layer 720 of the organic light emitting diode 70 in the selected pixel to emit light to the first electrode 710. The driving gate electrode 155 is connected to the first capacitive plate 158. The driving source electrode 176 and the second capacitive plate 178 are respectively connected to the common power source line 172. The driving drain electrode 177 is connected to the first electrode 710 of the organic light emitting element 70 through a contact hole 182.

By this structure, the switching thin film transistor 10 is operated by a gate voltage applied to the gate line 121 to serve to transmit a data voltage applied to the data line 171 to the driving thin film transistor 20. A voltage equivalent to a difference between a common voltage applied to the driving thin film transistor 20 from the common power source line 172 and a data voltage transmitted from the switching thin film transistor 10 is stored in the storage capacitor 80, and a current corresponding to a voltage stored in the storage capacitor 80 flows to the organic light emitting diode 70 through the driving thin film transistor 20 to allow the organic light emitting diode 70 to emit light.

Next, referring to FIG. 3 and FIG. 4, a structure of an organic light emitting diode (OLED) display according to the first exemplary embodiment will be described according to a deposition sequence.

A substrate member 111 that forms the display substrate 110 is formed of an insulating substrate that is made of glass, quartz, ceramic, plastic, or the like. A buffer layer 120 is formed on the substrate member 111. The buffer layer 120 prevents impurities from permeating and planarizes the surface, and may be formed of various materials that can perform these functions. The driving semiconductor layer 132 is formed on the buffer layer 120. The driving semiconductor layer 132 may be formed of polysilicon or an oxide semiconductor. The oxide semiconductor may include any one of oxides having titanium (Ti), hafnium (Hf), zirconium (Zr), aluminum (Al), tantalum (Ta), germanium (Ge), zinc (Zn), gallium (Ga), tin (Sn), or indium (In) as a base, and complex oxides thereof, such as zinc oxide (ZnO), indium-gallium-zinc oxide (InGaZnO4), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O). In the case where the semiconductor layer 131 is formed of the oxide semiconductor, a separate protective layer may be added to protect the oxide semiconductor that is weak to external environment factors such as high temperatures.

In addition, the driving semiconductor layer 132 includes a channel region 135 in which an impurity is not doped, and a source region 136 and a drain region 137 that are p+ doped at both ends of the channel region 135. A gate insulating layer 140 that is formed of silicon nitride (SiNx) or silicon oxide (SiO2) is formed on the driving semiconductor layer 132. A gate wire that includes the driving gate electrode 155 is formed on the gate insulating layer 140. In addition, the gate wire further includes the gate line 151, the first capacitive plate 158, and the other wire. Further, the driving gate electrode 155 is formed so as to overlap at least a portion of the driving semiconductor layer 132, particularly the channel region 135.

The interlayer insulating layer 160 that covers the driving gate electrode 155 is formed on the gate insulating layer 140. The gate insulating layer 140 and the interlayer insulating layer 160 together have through-holes that expose the source region 136 and drain region 137 of the driving semiconductor layer 132. The interlayer insulating layer 160, like the gate insulating layer 140, is made of a ceramic-based material such as silicon nitride (SiNx) or silicon oxide (SiO2).

The data wire that includes the driving source electrode 176 and driving drain electrode 177 is formed on the interlayer insulating layer 160. In addition, the data wire further includes the data line 171, the common power line 172, the second capacitive plate 178, and the other wire. The driving source electrode 176 and driving drain electrode 177 are connected to the source region 136 and drain region 137 of the driving semiconductor layer 132 through the through-holes that are formed on the interlayer insulating layer 160 and gate insulating layer 140.

The driving thin film transistor 20 that includes the driving semiconductor layer 132, the driving gate electrode 155, the driving source electrode 176, and the driving drain electrode 177 is formed as described above. The constitution of the driving thin film transistor 20 is not limited to the above examples, but may be variously modified with the known constitution that can be easily performed by those who are skilled in the art.

A planarization layer 180 that covers the data wires 172, 176, 177, and 178 is formed on the interlayer insulating layer 160. The planarization layer 180 removes a step and performs planarization in order to increase the luminous efficiency of the organic light emitting diode 70 to be formed thereon. In addition, the planarization layer 180 has an electrode contact hole 182 that exposes a portion of the drain electrode 177.

The first electrode 710 of the organic light emitting diode 70 is formed on the planarization layer 180. That is, the organic light emitting diode (OLED) display 100 includes a plurality of first electrodes 710 that are disposed for a plurality of pixels. The plurality of the first electrodes 710 are separated from each other. The first electrode 710 is connected to the drain electrode 177 through the electrode contact hole 182 of the planarization layer 180.

In addition, a pixel defining film 190 that has an opening that exposes the first electrode 710 is formed on the planarization layer 180. That is, the pixel defining film 190 has a plurality of openings that are formed for each pixel. The first electrode 710 is disposed so as to correspond to the opening of the pixel defining film 190. An organic emission layer 720 is formed on the first electrode 710, and the second electrode 730 is formed on the organic emission layer 720. The organic light emitting diode 70 that includes the first electrode 710, organic emission layer 720, and the second electrode 730 is formed as described above.

The organic emission layer 720 emits white light and is formed of a low molecular weight organic material or a high molecular weight organic material. The organic emission layer 720 may be formed of a multilayer that includes the emission layer and at least one of a hole injection layer (HIL), a hole transport layer (HTL), an electron transport layer (ETL), and an electron injection layer (EIL). In the case of when all of the additional layers are included, the hole injection layer (HIL) is disposed on the first electrode 710 that is the anode, and the hole transport layer (HTL), the emission layer, the electron transport layer (ETL), and the electron injection layer (EIL) are sequentially layered thereon.

The first electrode 710 and the second electrode 730 may be formed of a transparent conductive material, respectively, or a semitransparent or reflective conductive material. According to the kind of the material that forms the first electrode 710 and the second electrode 730, the organic light emitting diode (OLED) display 100 may be a front surface light emitting type, a rear surface light emitting type, or both surface light emitting type.

A color filter 320 is formed on the second electrode 730. The color filter 320 includes a red color filter 320R formed at the red subpixel (R), a green color filter 320G formed at the green subpixel (G), and a blue color filter 320B formed at the blue subpixel (B), and a color filter is not separately formed at the white subpixel (W).

As described above, the organic emission layer 720 emitting the white light is formed at all of the red subpixel (R), the green subpixel (G), the blue subpixel (B), and the white subpixel (W), and the red color filter 320R, the green color filter 320G, and the blue color filter 320B are respectively formed at the red subpixel (R), the green subpixel (G), and the blue subpixel (B), thereby realizing the color image.

An encapsulation substrate 210 faces the display substrate 110 and is formed on the color filter 320. The encapsulation substrate 210 is a substrate with a plate shape that encapsulates at least the display area (DA) in the display substrate 110 in which the organic light emitting element is formed, in the case of when it is a front surface light emitting type or a both surface light emitting type, it is formed of a transparent material such as glass or plastic, and in the case of when it is a rear surface light emitting type, it is formed of an opaque material such as a metal.

The encapsulation substrate may be formed of a thin film encapsulation film including a plurality of thin films. The thin film encapsulation film may be formed by alternately forming at least one organic layer and at least one inorganic layer.

The organic layer is formed of a polymer, and desirably it may be a single layer or a deposition layer including one of polyethylene terephthalate, a polyimide, a polycarbonate, an epoxy, polyethylene, and a polyacrylate. Further desirably, the organic layer can be formed with a polyacrylate, and in detail, it includes a polymerized monomer composition including a di-acrylate monomer and tri-acrylate monomer. A mono-acrylate monomer can be included in the monomer composition. A photoinitiator such as TPO can be further included in the monomer composition, but is not limited thereto.

The inorganic layer can be a single layer or a deposition layer including a metal oxide or a metal nitride. In detail, the inorganic layer can include one of SiNx, Al2O3, SiO2, TiO2, or the like. The externally exposed uppermost layer of the encapsulation layer 210 can be formed with an inorganic layer so as to prevent permeation of vapor into the organic light emitting element.

The encapsulation layer can include at least one sandwich configuration in which at least one organic layer is inserted between at least two inorganic layers. Further, the encapsulation layer can include at least one sandwich configuration in which at least one inorganic layer is included between at least two organic layers.

While this disclosure has been described in connection with certain embodiments, it is to be understood that the invention is not limited to the disclosed embodiments, but, on the contrary, is intended to cover various modifications and equivalent arrangements included within the spirit and scope of the appended claims.

What is claimed is:

1. An organic light emitting diode (OLED) display comprising:

a substrate; and a plurality of red subpixels, a plurality of green subpixels, a plurality of blue subpixels, and a plurality of white subpixels arranged in a matrix of rows and columns on the substrate, wherein three different-colored subpixels of the red subpixel, the green subpixel, the blue subpixel, and the white subpixel form one pixel in which said three different-colored subpixels are simultaneously driven wherein one green subpixel, one blue subpixel, and one white subpixel are disposed between two red subpixels of a row in the matrix, wherein one green subpixel, one blue subpixel, and one white subpixel are disposed between two red subpixels of a column in the matrix, wherein the display includes a first row pixel, a second row pixel, a third row pixel, a fourth row pixel in which three subpixels of the subpixels are disposed in a row direction with different orders, and wherein the first row pixel includes the red subpixel, the green subpixel, and the blue subpixel disposed from left to right, the second row pixel includes the blue subpixel, the white subpixel, and the red subpixel disposed from left to right, the third row pixel includes the green subpixel, the red subpixel, and the white subpixel disposed from left to right, and the fourth row pixel includes the white subpixel, the blue subpixel, and the green subpixel disposed from left to right.

2. The organic light emitting diode (OLED) display of claim 1, wherein the display includes a first column pixel, a second column pixel, a third column pixel, and a fourth column pixel in which three subpixels of the subpixels are disposed in a column direction in different orders, the first column pixel includes the red subpixel, the blue subpixel, and the green subpixel disposed top to bottom, the second column pixel includes the green subpixel, the white subpixel, and the red subpixel disposed top to bottom, the third column pixel includes the blue subpixel, the red subpixel, and the white subpixel disposed top to bottom, and the fourth column pixel includes the white subpixel, the green subpixel, and the blue subpixel disposed top to bottom.

3. The organic light emitting diode (OLED) display of claim 2, wherein the red subpixel, the green subpixel, the blue subpixel, and the white subpixel are disposed from left to right in the first row, the blue subpixel, the white subpixel, the red subpixel, and the green subpixel are disposed from left to right in the second row under the first row, the green subpixel, the red subpixel, the white subpixel, and the blue subpixel are disposed from left to right in the third row under the second row, and the white subpixel, the blue subpixel, the green subpixel, and the red subpixel are disposed from left to right in the fourth row under the third row.

4. The organic light emitting diode (OLED) display of claim 3, wherein, in the subpixel group, the red subpixel, the blue subpixel, the green subpixel, and the white subpixel are sequentially disposed from top to bottom at the first column, the green subpixel, the white subpixel, the red subpixel, and the blue subpixel are sequentially disposed from top to bottom at the second column to the right of the first column, the blue subpixel, the red subpixel, the white subpixel, and the green subpixel are sequentially disposed from top to bottom at the third column to the right of the second column, and the white subpixel, the green subpixel, the blue subpixel, and the red subpixel are sequentially disposed from top to bottom at the fourth column to the right of the third column.

5. The organic light emitting diode (OLED) display of claim 4, wherein the subpixel group is repeatedly disposed.

* * * * *